United States Patent [19]

Chandler

[11] 4,271,549

[45] Jun. 9, 1981

[54] CONNECTION MEANS FOR A KNOCK-DOWN BOAT

[75] Inventor: Roy L. Chandler, Arlington, Tex.

[73] Assignee: Advanced Marine Concepts, Inc., Arlington, Tex.

[21] Appl. No.: 2,877

[22] Filed: Jan. 12, 1979

[51] Int. Cl.[3] ..... B63B 7/00

[52] U.S. Cl. ..... 9/2 S; 114/61

[58] Field of Search ..... 9/2 R, 2 S, 2 C, 2 F; 114/61, 77 R, 77 A; 24/221 R, 221 A; 151/44, 54, 60-65

[56] References Cited

U.S. PATENT DOCUMENTS

| | | | |
|---|---|---|---|
| 1,142,192 | 6/1915 | Morgan | 151/60 |
| 1,413,976 | 4/1922 | Fiehler | 151/54 |
| 2,178,170 | 10/1939 | Hager | 151/54 |
| 2,676,619 | 4/1954 | Consoletti | 151/54 |
| 3,121,887 | 2/1964 | Baretta | 9/2 C |
| 3,473,502 | 10/1969 | Wittkamp | 114/61 |

FOREIGN PATENT DOCUMENTS

| | | | |
|---|---|---|---|
| 421454 | 11/1925 | Fed. Rep. of Germany | 9/2 R |
| 1325043 | 3/1963 | France | 24/221 R |
| 709204 | 6/1966 | Italy | 114/61 |

*Primary Examiner*—Trygve M. Blix
*Assistant Examiner*—Jesus D. Sotelo
*Attorney, Agent, or Firm*—Charles W. McHugh

[57] ABSTRACT

A relatively small watercraft includes a pair of spaced and usually parallel pontoons. A personnel station extends generally between and above the two spaced pontoons. A structural frame of tubular members or bars supports the personnel station; the tubular members may be selectively connected to the pontoons, or the frame may be permanently connected to them. In one embodiment wherein the structural frame and the pontoons are only temporarily connected, a plurality of eye bolts and specially positioned slots are utilized so that the eye bolts need never be removed from the watercraft. (In this embodiment, there are no connecting pieces to ever get lost, even when the three main sub-assemblies of the watercraft are disassembled.) The eye bolts are aligned longitudinally with the slots for disassembly, and turned transversely to the slots to hold the tubular members to the pontoons. Dimples or recesses in the tubular members can be provided to inhibit unwanted rotation of an eye bolt. Special clips or slot-filling members may also be used to prevent unwanted rotation of the eye bolts.

6 Claims, 12 Drawing Figures

CONNECTION MEANS FOR A KNOCK-DOWN BOAT

The present invention relates generally to a relatively small watercraft for supporting one or more persons; and, more particularly, it relates to a pontoon boat structure having a deck which extends between a pair of generally parallel pontoons. The invention is particularly advantageous for use as a recreation vehicle and as a stable platform for hunters and fishermen.

It is well known to provide relatively small pontoon boats which utilize a pair of pontoons arranged in a generally parallel configuration. Exemplary of such boats is that shown in U.S. Pat. No. 3,083,382 to Havens and Villines. When the boats are sufficiently stable, they are promoted as floating platforms for hunting waterfowl such as ducks; exemplary of such a construction is that shown in U.S. Pat. No. 3,548,773 to Laughlin. Exemplary of watercraft specifically designed merely for recreation on water is that shown in U.S. Pat. No. Des. 221,809 to Love; and a construction designed for fishing and hunting is shown in U.S. Pat. No. 1,093,475 to Rosing. Hence, it should be understood that there is a significant quantity of prior art with regard to small watercraft intended for recreational use, etc. However, in spite of the many proposals for such small watercraft that have been made from time to time, there have been relatively few—if any—that have enjoyed any widespread commercial success, as evidenced by the lack of any extensive manufacturing and marketing of such craft.

Perhaps one reason that proposals for some watercraft have met with little success has been the expense that has been involved in manufacturing what might be politely referred to as complicated designs for both pontoons and connecting structures. Accordingly, it is an object of this invention to provide a design which has substantially all of the good features of certain watercraft but which achieves those advantages through a relatively straight-forward design with very few frills. With the simplified design disclosed herein, both manufacturing and subsequent handling can be accomplished by only one man, and no parts are so bulky or heavy as to require the assistance of mechanized equipment for transportation or movement of the sub-assemblies of the watercraft.

Perhaps another reason for the lack of commercial success of some previous designs has been the substantial weight of an assembled boat. Accordingly, it is another object of this invention to provide a design which permits the watercraft to be easily disassembled into three main sub-assemblies, namely, the two pontoons and a connecting super-structure on which a personnel station is mounted. Ideally, each of these sub-assemblies weighs no more than about 50 to 60 pounds, which is light enough to be readily handled by most adults. Hence, the sub-assemblies can be readily handled by the average hunter or fisherman without the need for special load-carrying equipment.

Still another possible reason for the lack of acceptance of certain prior watercraft is that they were designed to be relatively wide—for stability—when placed in the water; but, when on land and not in use, they took up too much space to be tolerable. Accordingly, it is another object of this invention to provide a catamarantype watercraft which can be readily knocked down into compact sub-assemblies whenever the user wishes to transport or store the watercraft on land.

A further object of this disclosure is to teach a knock-down watercraft in which the connecting members (including certain eye bolts and associated members) need never be separated from the watercraft. With such an arrangement, there is no possibility of a connecting element ever becoming lost or dropped overboard in the middle of a lake, etc. Hence, the frustration which would surely arise if someone took a watercraft to a lake or pond and belatedly discovered that a critical element was inadvertently left at home is completely avoidable with a construction shown herein. Furthermore, the expense of obtaining replacement parts for those connecting pieces which might otherwise become lost is completely avoidable with this invention.

These and other objects and advantages should become more apparent from a reading of the specification and the claims appended thereto, as well as the accompanying drawing in which:

In brief, the invention generally includes a pair of spaced and usually parallel pontoons, each of which consists of an elongated body of closed-cell foamed plastic such as polystyrene. A load-distribution truss is provided on top of each of the foamed cell bodies, for transferring vertical loads to said bodies. A personnel station extends generally between the two spaced pontoons and above said pontoons. The personnel station is sufficiently narrow so as to restrict personnel on the station to a central portion of the watercraft. A structural frame of tubular members or the like may be selectively connected to the pontoons, or the frame may be permanently connected to them. In one embodiment wherein the structural frame and the pontoons are only temporarily connected, a plurality of eye bolts and specially positioned slots are utilized so that the eye bolts need never be removed from the watercraft. (In this embodiment, there is nothing to ever get lost, even when the three main sub-assemblies of the watercraft are disassembled.) The watercraft also includes a generally puncture-resistant skin which surrounds each of the foamed plastic bodies and protects those bodies from being abraded or attacked by chemicals, etc.

Figure 1:
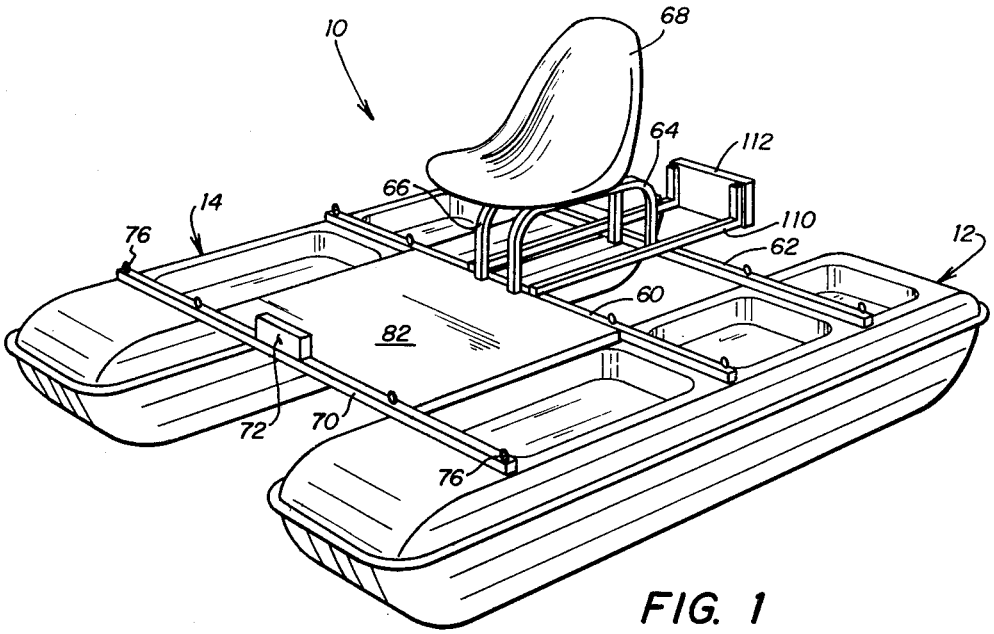
FIG. 1 is a perspective view of a watercraft made in accordance with the invention, with a personnel station adapted to carry a single person.
Figure 2:
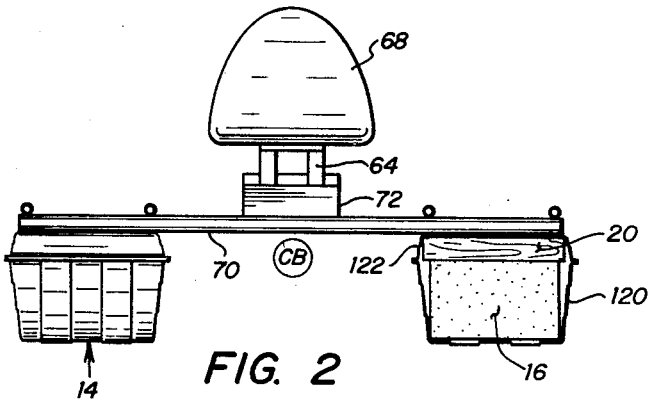
FIG. 2 is a front, elevational view of the watercraft shown in FIG. 1, with one of the pontoons shown sectioned.
Figure 3:
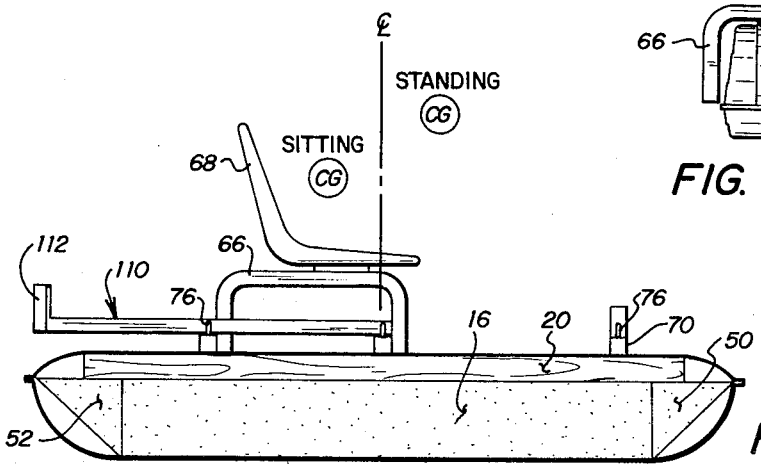
FIG. 3 is a side, elevational view of the one-man watercraft shown in FIG. 1, with the pontoon being shown in cross-section.

Referring initially to FIG. 1, a watercraft 10 intended specifically for a single occupant is shown from the left front end of the craft as it would sit on dry ground. Referring additionally to FIGS. 2 and 3, the watercraft 10 includes a pair of spaced and generally parallel pontoons 12, 14, each of which consists of an elongated body 16 of foamed plastic surrounded by a skin 18 which is more fully described hereinafter. Each body 16 has a longitudinal axis and a length of at least two meters in order to provide an optimum amount of stability for the watercraft in the water. Preferably each pontoon 12, 14 has a total length of about 90 inches, and a total width of about 20 inches. Hence, the preferred length-to-width ratio is about 4½. The foamed-cell body 16 also has a generally square cross-section as viewed in a transverse direction, so that the flat bottom of the floatation body will provide a maximum amount of water displacement in relation to the depth of immersion of the pontoon into water. That is, a square cross-section is preferred over a circular cross-section because a greater quantity of water is displaced per unit measurement of immersion. Thus, the rectangular configuration shown herein is much preferred over round or triangular shapes such as those shown in U.S. Pat. No. 3,321,784 to Rasmussen.

Figure 4:
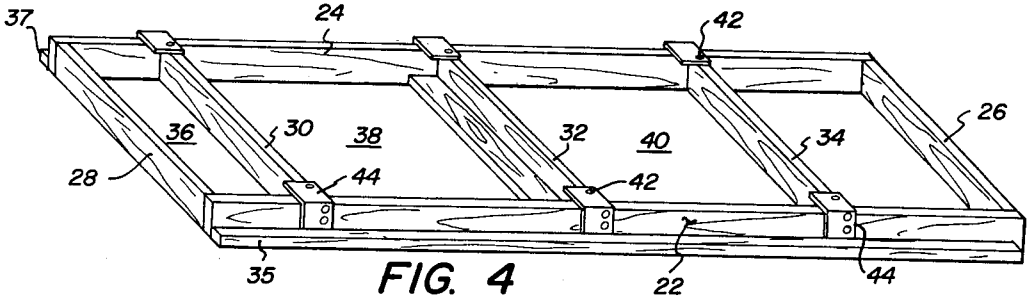
FIG. 4 is a perspective view of a wooden truss for use in a pontoon of the invention.

Referring next to FIG. 4, a load-distribution truss 20 is provided on top of each of the foamed cell bodies 16 for transferring vertical loads to said bodies in an approximately uniform manner. The preferred construction for such a truss 20 includes a plurality of horizontally oriented members, each of which has a nominal size of 1 by 4 inches. The truss members include two longitudinal members 22, 24 forming sides, and two transverse members 26, 28 which constitute the end pieces for a truss. Also provided interiorly of the truss 20 are a plurality of intermediate and transversely oriented members 30, 32 and 34. All of the structural members 22–34 are preferably oriented with the longer of their two dimensions being oriented vertically, in order to optimize the capacity of the truss to sustain vertical loading. And, to increase the area through which loads are transferred from the truss 20 to the foam body 16, a narrow foot 35, 37 (approximately one inch wide) can be fixed to the bottom of each side member 22, 24. Such appendages 35, 37 are preferable to substituting heavier 2×4 inch wood pieces for 1×4 inch pieces; and keeping the weight of a pontoon low while maintaining its strength high is an important feature of the construction shown herein. The load-carrying ability of a pontoon is equal to the weight of the water it displaces—less its own weight; it is therefore important to keep the truss' weight as low as practicable, e.g., about 15 pounds.

Between the members 28, 30 is a vertically open recess 36, i.e., a recess which is free and unobstructed as viewed from the "top" of the truss when it is installed on a horizontally disposed pontoon. A similar recess 38 which is provided between the cross-members 30, 32 and a recess 40 between members 32, 34. These recesses 36, 38, 40 are subsequently used to receive and partially support depressed portions of the skin 18, so as to provide built-in "wells" on top of each pontoon for storing tackle boxes, ice chests, batteries, etc.

Each truss 20 carries a plurality of nuts 42 which are held in place by metal brackets 44 which are connected to the side members 22, 24 with suitable fasteners. The plurality of nuts 42 are arranged at the top of the truss in a fixed pattern which matches the pattern of apertures in a structural frame 46 that connects the side-by-side pontoons, 12, 14. In this way, connecting bolts can be readily used to pass through the skin 18 and join the structural frame 46 to respective nuts 42 carried by the truss. By providing suitable apertures in the frame 46 and skin 18, and using prefabricated trusses with fixed nut placement, ease of assembly of the watercraft is enhanced—whether by factory personnel or the sportsman-owner. Furthermore, the fact that the nuts 42 are "captured" and securely held within the pontoon at known locations means that the frame 46 can be selectively attached to and removed from the pontoons 12, 14 essentially any number of times.

With respect to the foamed plastic body 16 of each pontoon, the volume for each body should be at least three cubic feet in order to provide a minimum amount of buoyancy, and a preferred volume is on the order of 5 cubic feet. And, the preferred plastic material for said body 16 is a marine-grade closed-cell polystyrene which has flame-retardant additive therein; the additive serves to guard against a dangerous fire if a fisherman should accidentally drop a smoldering cigarette or a kerosene lantern on a pontoon while it is in the middle of a lake. A preferred density for the expanded cellular polystyrene which is favored for the bodies 16 is between 1 and 2 pounds per cubic foot. If the density of the cellfoam bodies 16 is much less than one pound, the bodies will not have sufficient strength to transfer any significant loads; and, low-density foam tends to be more susceptible to crumbling than high-density foam. Hence, it is believed that a minimum density of one pound per cubic foot is desirable for the bodies 16. At the other end of a possible range of satisfactory values, a density of about two pounds per cubic foot appears to offer an optimum value—because relatively little additional strength is gained when the density exceeds two pounds per cubic foot, and the cost of extra material makes any higher density a fiscal detriment. Accordingly, a range between about 1 to 2 pounds is believed to be optimum. The total volume of each body 16 is preferably large enough to displace sufficient water when it is immersed so as to provide buoyancy of at least 180 pounds; but a buoyancy of about 300 pounds per body 16 is advisable when there is a possibility that two persons may wish to ride on the watercraft 10. And, the pontoons 12, 14 preferably have filler pieces 50, 52 at each end of the pontoon to insure the displacement of additional water, in order that an optimum watercraft consisting of two pontoons about 2.3 meters long can readily support over 700 pounds of weight.

Figure 5:
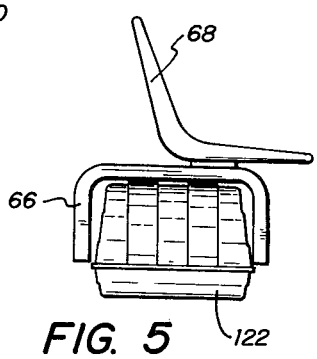
FIG. 5 is a front end view of one of the pontoons (inverted as compared with its showing in FIG. 2) nested within the connecting structure, in the manner that these two sub-assemblies might be transported to and from a lake.

The structural frame 46 basically includes two transverse members 60, 62 of tubular steel which are rigidly held together by virtue of two U-shaped members 64, 66. These U-shaped members 64, 66 serve a dual purpose in contributing lateral stability to the watercraft and supporting a chair 68 on which a fisherman might comfortably sit. The width of the U-shaped members (almost 20 inches) is preferably just slightly greater than the width of one of the pontoons; with such a construction the two transverse members 60, 62 and the attached members 64, 66 can be turned parallel to the longitudinal axis of one of the inverted pontoons and nested therewith—for compact traveling to and from a lake, etc. This feature is shown in FIG. 5. The structural frame 46 may also advantageously have a front transverse member 70, which is adapted to be connected to the two spaced pontoons 12, 14 ahead of the rear members 60, 62 but still interiorly of the rectangular envelope defined by the two pontoons 12, 14. Centrally positioned on this transverse member 70 is an upright piece 72 which is rigidly connected to the member (as by welding or the like) in order that the torque loads may be applied to piece 72. This short and relatively narrow element 72 is adapted to mount a commercially available trolling motor which would be powered by batteries carried by the watercraft. Thus, the same structural element which holds two pontoons in spaced and parallel relation also serves as a motormount for a trolling motor used to propel the watercraft.

Referring still to FIG. 1, a plurality of eye bolts 76 (typically 5/16×18) are provided to connect the structural frame 46 to the nuts 42 carried by the respective trusses 20. Eye bolts are the preferred connecting means for a watercraft of the type disclosed herein because they provide handy anchoring spots for various tie-down ropes, and because they are not symmetrical about a vertical axis through the shank. Hence, when oriented in one direction, eye bolts have a significantly different width than they have when they are turned 90° degrees. And, this characteristic of eye bolts—and how they are optimally employed on a watercraft of the type shown in FIG. 1—will be described more fully hereinafter.

A personnel station 80 is adapted to carry at least one person above and generally between the two spaced pontoons 12, 14; the station preferably includes a generally planar deck or platform 82 along with the aforementioned chair 68. The personnel station 80 preferably has a width which is sufficiently narrow so as to restrict the center of gravity of personnel on said station to a space which lies internally of the longitudinal axes of the pair of pontoons 12, 14. Also, the personnel station 80 is limited in size, longitudinally, such that a person remaining on the station is within the central two-thirds of the pontoon's length. This deliberate limiting of the personnel deck 82 and seat 68 is for the purpose of insuring a high degree of stability of the watercraft, since it is essentially impossible to overturn the craft in tranquil water if a person stays within the area defined by the personnel station.

As clearly indicated in FIG. 1, the personnel station permits both sitting and standing of an occupant of the watercraft. The station 80 is centrally located and is sufficiently small so that the center of gravity of an occupant will shift from just behind to just ahead of the watercraft's center of gravity when the occupant changes from a sitting to a standing position. To explain this more completely, it is clear that a person cannot readily stand in the same fixed spot where he is provided with a comfortable seat. So, if the person is to both sit and stand on the watercraft during its normal usage, his center of gravity will be different—relative to that of the boat—in these two normal positions. By deliberately locating the chair 68 slightly to the rear of the transverse member 60 (which lies on the centerline of the watercraft), and placing the small deck 82 just ahead of the central member 60, an occupant of the watercraft inherently changes the over-all center of gravity by a minimum amount as he shifts back and forth from sitting to standing, etc. In this way, the stability of the watercraft is enhanced for both the occupant-seated and the occupant-standing configurations. (See also FIG. 3.) Of course, this is particularly important for both fishermen and hunters who are likely to use the watercraft, in that they do not have to focus any significant attention on maintaining their balance on the watercraft when they are attempting to land a troublesome fish or follow the erratic flight of a freightened duck.

Figure 6:
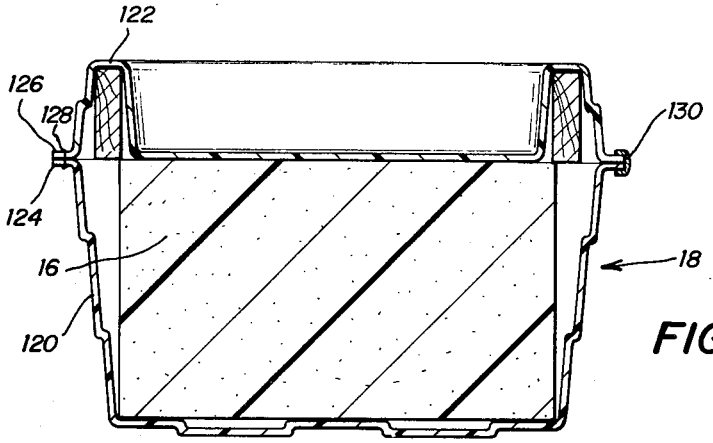
FIG. 6 is a cross-sectional elevational view taken from one end of a pontoon and more clearly illustrating the preferred skin construction.

Turning next to another part of the watercraft, and referring specifically to FIG. 6, a waterproof and generally puncture-resistant skin 18 is provided to protect each of the pontoons 12, 14. The skins 18 are preferably made of tough polyethylene plastic having a thickness of about 0.125 inch. One reason that polyethylene is a desirable exterior material is because it is highly resistant to solvents and the various liquids that are common around small boats, including gasoline, battery acid, lantern fuel, etc. Of course, all of these liquids are the same kinds of liquids that are notorious in attacking the preferred cellular floatation material. From a chemical point of view, then, one of the weakest possible materials in resisting chemical attack (foamed polystyrene) is protected in this design by one of the best possible materials (polyethylene sheet). Polyethylene may also be formed with reasonable ease using vacuum molding techniques that eliminate the need for extremely expensive molds. Polyethylene may also be colored to satisfy a variety of personal preferences, including mauve or green for duck hunters, and red or white for recreation or fishing use.

Each skin 18 is preferably smooth along its sides and bottom, in order to reduce drag as a pontoon is moved through the water. Any strengthening ribs or ridges are deliberately made parallel to the longitudinal axis of a pontoon. And, each skin 18 advantageously includes a relatively deep bottom piece 120 and a relatively shallow top piece 122. The region of contact between the two skin sections 120, 122 is ideally formed by generally horizontal and co-extensive lips 124, 126 on the respective pieces. These lips 124, 126 extend around the periphery of a pontoon and outwardly for about 1/2 inch, in order to provide ample space for effecting a reliable connection (either mechanical or chemical) between the two pieces 120, 122. Examples of a mechanical connection include wire staples 128 which may be placed vertically through the overlapping edges 124, 126 at a plurality of places around the pontoon. Alternatively, an adhesive or heat sealing technique may be employed to join the two skin sections 120, 122 into a completely sealed protective skin. One reason for preferring that the entire skin 18 constitute an integral and sealed element is to essentially preclude the entrance of any water into the interior of a pontoon. However, it is the floatation that is realized from the closed-cell bodies 16 that provides the basic supporting capability for the watercraft. That is, even if one wall of the lower shell 120 should be punctured and a pontoon should fill with water, the closed-cell foam of body 16 will insure that the watercraft does not sink.

While the floatation bodies 16 are particularly effective at providing buoyancy for a pontoon when said bodies are made of the preferred material (expanded cellular polystyrene), such floatation bodies are not resistant to the kind of physical damage that routinely occurs in a watercraft of this type. For example, unprotected bodies of cellfoam are subject to attack from animals such as ducks if the boats are left alone in isolated locations; and they are also capable of being damaged by submerged stumps during travel, because of the friable nature of cellfoam. Additionally, an edge or corner of a floatation body 16 could be easily crumbled during loading and unloading on a car or truck if there was no protective skin around it. Hence, a puncture-resistant and "tough" polyethylene skin 120, 122 for the cellfoam is highly desirable.

Another characteristic of the skin 18 is perhaps deserving of at least some attention, and that is that the skin is not designed to be, and does not have to be, a load-bearing part of the watercraft during normal use. That is, floatation is intended to be supplied by the cellfoam bodies 16, and upward buoyancy loads are passed directly from the bodies 16 to the trusses 20 and to the connecting structure 46. When the boat 10 is out of the water and is being carried by two or more persons, the skin only needs to have sufficient tensile strength to support the weight of a body 16 (and, depending on where the boat has been manually gripped, perhaps the additional weight of a truss 20) so as to prevent the body from falling downward away from the raised structure 46 and/or truss 20. That is, without a supporting skin 18 under a cellfoam body 16, the body would fall away from a truss 20 held in midair. However, the lack of any direct structural connection between a truss and a floatation body is a matter of choice based upon economy of materials and parts, and ease of manufacturing. Therefore, if there was some reason to introduce a rigid physical connection between the trusses and the floatation bodies, then it would certainly be feasible.

In order to reduce the possibility of water entering a pontoon 12, 14 through a mechanically joined skin 18, a U-shaped bumper 130 is preferably placed around the juxtaposed edges 124, 126. If desired, a few light-weight staples may be employed to insure that the bumper 130 stays in place. One reason for preferring a mechanical joint with staples 128 (which are hidden by cosmetic strip 130) is that any water which might somehow accumulate within a pontoon could gradually drain through a mechanically sound—but unsealed—joint if the pontoon is stored on its side or one end. And, while it is certainly not anticipated that water would be deliberately admitted to a pontoon, prudence dictates that there be some means for draining water from the pontoon if it should ever accumulate therein. While trapped water in a pontoon 12 would never be enough to introduce the possibility of sinking it, a gallon or two of water might add enough weight to a pontoon to make it much less comfortable to carry, or less convenient to lift to the top of an automobile for transportation to a lake, etc.

The location of the joint between skin pieces 120, 122—near the top of a given pontoon—is based upon two considerations. First, it is desirable that an uninterrupted and continuous waterproof surface be presented on the bottom of a pontoon; this is to more nearly insure that water cannot enter a pontoon under normal conditions. Additionally, the location of the joint near the top of the pontoon provides a particularly useful gripping place for the manual lifting of a pontoon. Thus, a person wishing to lift or move a single pontoon can easily find a sturdy and convenient gripping spot anywhere around the periphery of the pontoon. Furthermore, it is known that people can lift greater weights when lifting is from at least a partially elevated location as compared with lifting directly from the floor. Therefore, by placing the natural gripping spots for a pontoon near the top of said pontoon, there is more assurance that the pontoon can be comfortably handled by an average adult male. With a truss 20 made of $1\times4$ inch lumber and a cellfoam body 16 having a density of about one pound per cubic foot, a pontoon having a length of just under 90 inches will weigh only about 50 pounds. The structural frame 46 and the personnel station 80 have a combined weight of about 60 pounds—which should be readily handled by most adult males who have the stamina and aptitude to be seriously interested in boating, fishing and outdoor sports, etc. Thus, the total weight of the entire watercraft is about 160 pounds, and each of the three main sub-assemblies of the watercraft is light enough to be readily carried by an average adult.

Figure 7:
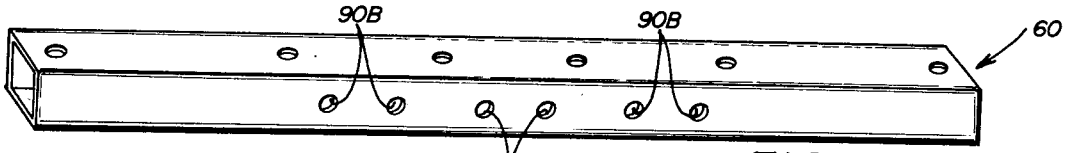
FIG. 7 is a perspective view of one of the tubular connecting members which also supports the framework for a swivel seat.
Figure 8:
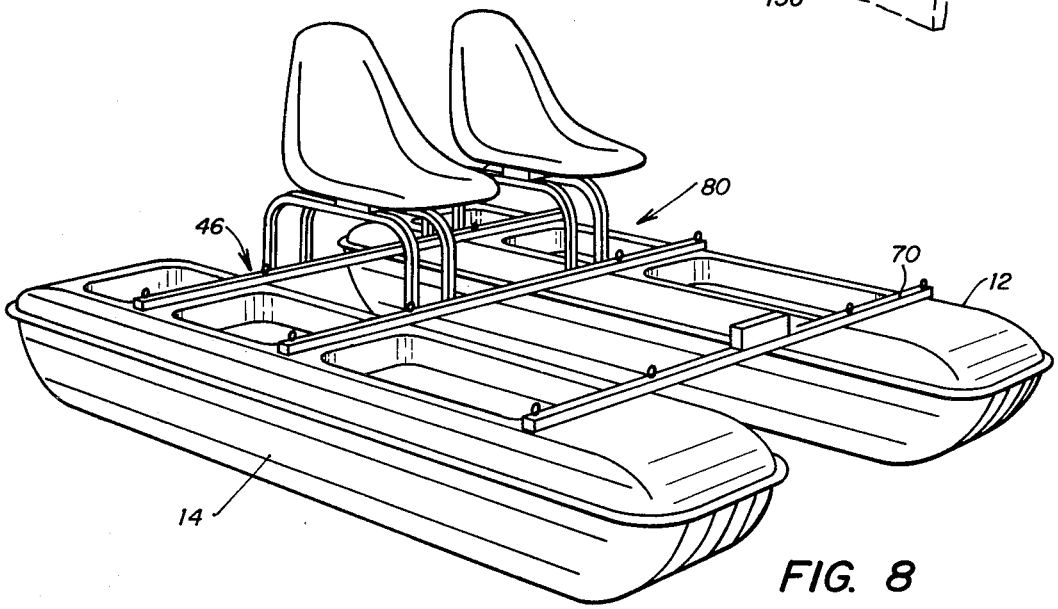
FIG. 8 is a perspective view of the watercraft disclosed herein and including an arrangement for readily carrying two persons.

Another advantage of the construction of the structural frame 46 is that the apertures 90 for receiving bolts used in mounting the members 64, 66 are such that the personnel station can be readily configured as a one-man station or two-man station—with relatively little difficulty. As shown in FIG. 7, the apertures 90A are utilized when a single seat is to be provided as a part of the personnel station 80, and the apertures 90B are utilized when two side-by-side seats are to be provided—as shown in FIG. 8. The conversion back and forth between the one-man and two-man configurations is a simple matter, requiring only the relocation of a few ordinary bolts.

Figure 9:
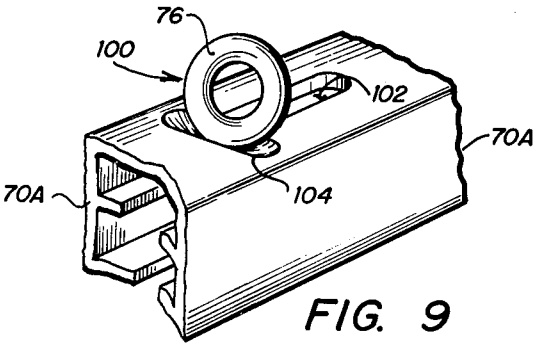
FIG. 9 is a perspective, fragmentary view of one of the three cross-pieces which hold two pontoons in spaced relation, and illustrating one means for connecting a cross-piece to a pontoon.

Referring next to FIG. 9, a construction which permits the watercraft to be easily disassembled (i.e., knocked down) is illustrated. This construction is particularly advantageous in that no loose parts need ever be created when the attachment means is loosened, so that there is no opportunity for a person to accidentally leave behind, or drop overboard, any functional part of the boat. The preferred attachment means 100 for a knock-down boat includes a plurality of relatively short slots 102 provided in one side of an elongated structural member such as member 70A. Such a member 70A may be an aluminum extrusion which has a longitudinal opening in the side which is opposite that side having slot 102 therein. When such a structural member is employed, the appropriate number of slots 102 may be punched in the member 70A with a hydraulic press or the like, so as to avoid a more expensive and time consuming drilling operation. Additionally, it is a relatively simple operation to create an upset portion (or dimple) 104 in the top surface of member 70A at the same time that a slot 102 is punched in member 70A. This dimple 104, which can provide a built-in locking capability for an eye bolt, is preferably located near the extreme outer end of a slot 102. For those slots which are located along an intermediate portion of the member 70A, the location of a dimple with respect to its associated slot is most effective if it is away from the center of the watercraft. As for the size of the slot, it has a width and length which is appropriate to pass the eye portion of an eye bolt 76 when the eye bolt is aligned longitudinally with respect to member 70A, and to hold member 70A securely to a second member (such as truss 20) when aligned transversely thereto.

In use, a plurality of eye bolts may be installed in the nuts carried by each pontoon at the time that a boat is prepared for shipment at the factory, or at the time the boat is prepared for delivery to a customer. Until such time as the bolts are installed, all of the exterior walls of the pontoons are smooth—and there are no sharp edges, brackets or protruding bolts that could tear into any adjacent structure. Furthermore, the fact that there are no protruding bolts or the like means that nothing is vulnerable to being bent or broken because of their exposed position; hence, the pontoons are less likely to be rendered unserviceable as a result of being handled during back and forth travel between various lakes and the owner's home. However, having once been threaded a sufficient distance into the associated nuts, the eye bolts 76 need never be removed again. At the time that the boat is to be assembled for use on water, the eye bolts are merely turned so that they are all parallel to the longitudinal axis of a tubular rod. The individual pieces of the structural frame 46 are then positioned so that they easily slide over and envelope the four co-planar eye bolts at appropriate positions along the pontoons. The eye bolts are then tightened until they begin to bear tightly against the top surface of a tubular member—such as 70A. An eye bolt 76 would then be turned clockwise slightly more until it comes to rest within a locking dimple 104 and cannot be readily turned any further.

With the two pontoons separated by the maximum distance that is contemplated for a given boat, the planar deck 82 may then be positioned within the space defined by the four "interior" eye bolts which extend above structural members 60, 70 (FIG. 1). By sizing the deck 82 so that its longitudinal edges fit tightly between the eye bolts along a respective structural member, those eye bolts are prevented from any further turning—which serves to even more securely lock the boat together and prevent any relative movement between parts. Whenever a person desires to disassemble such a watercraft, it is only necessary that the platform 82 be initially lifted from its resting position, and then all of the bolts are turned ninety degrees. The only tool that is needed is some kind of a lever arm; and a person could use a screwdriver, pliers' handle, pocket knife, or even a strong limb in order to achieve sufficient leverage to turn an eye bolt ninety degrees. The cross pieces 60, 62, 70 can then simply be lifted vertically over the eye bolts and the watercraft has been immediately converted into its three principal sub-assemblies.

On the other hand, if a person should want to assemble his watercraft so that there was no chance for an eye bolt to ever pass through an associated slot, a flat washer can simply be put underneath the eye bolt before it is threadably engaged with a concealed nut. The captured washer would then lock the eye bolt and tube together regardless of the orientation of the eye bolt with respect to its associated slot. If the boat owner should later choose to change the status of those attachments which are fixed and those which are merely temporary, he need only unthread a given eye bolt and add or remove a washer—depending on whether he wants to preclude or promote the "knock-down" characteristics of the boat.

Figure 10:
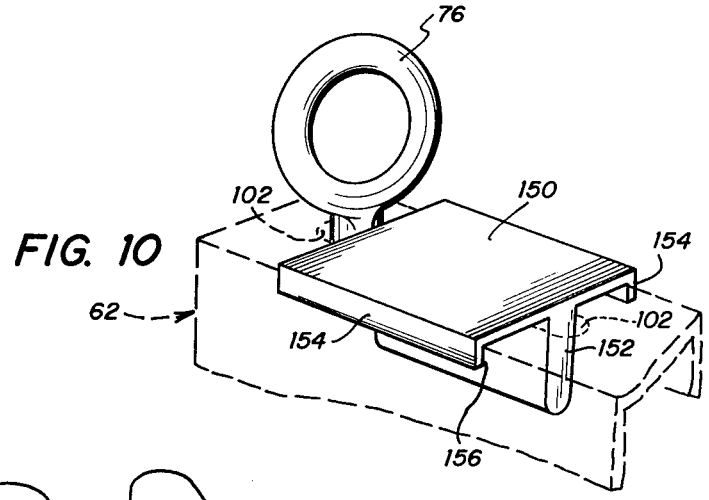
FIG. 10 is a perspective view of one technique for locking an eye bolt securely to a tubular cross-member.

Referring next to FIG. 10, another technique for securely locking an eye bolt 76 to one of the cross members is shown. The principle involves use of a locking member 150 which has a central dependent tongue 152 which is adapted to engage a slot 102; the tongue is not as long as the slot, so that there is room for the bolt's shank to also be in the slot. By effectively taking up the excess space alongside the shank, the tongue 152 prevents the eye bolt from becoming centered in the slot—where it could be removed. The generally T-shaped device 150 also has depending lips 154 on each side of the top piece, and these dependent lips each have an inwardly turned portion 156 which snugly embraces the cross member so that the device will not be bounced out of its secured position.

Figure 12:
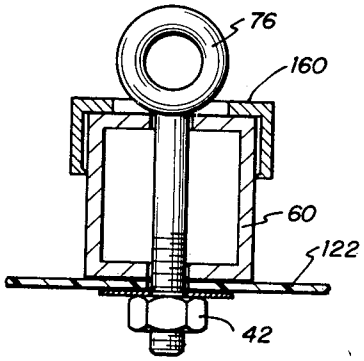
FIG. 12 is a cross-sectional view, in front elevation, of the embodiment shown in FIG. 11.
Figure 11:
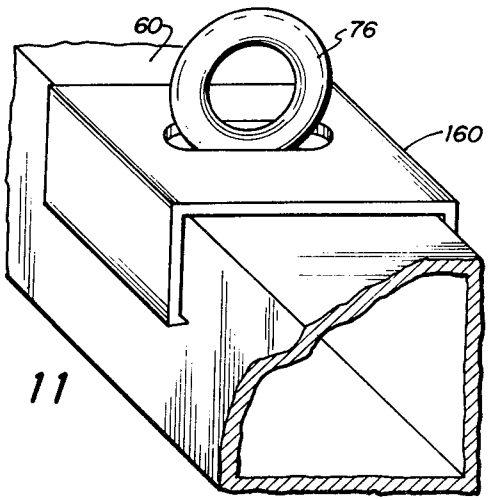
FIG. 11 is a perspective view of another embodiment for locking an eye bolt to a cross-member.

An alternative locking device is shown in FIG. 11, wherein an eye bolt is maintained in a transverse orientation with respect to the longitudinal slot. The transverse orientation is insured by virtue of the inability of an eye bolt 76 to rotate (because of structural interference) whenever the U-shaped clip 160 is positioned over a transverse eye bolt and pushed firmly down over a cross member. This structural interference is clearly visible in FIG. 12, where the lower portion of the eye bolt "ring" or "eye" is at the same elevation as a side part of clip 160.

In addition to the front motor mount 72 which is provided for mounting an electrical trolling motor, an optional structure 110 is readily affixed to the structural frame 46; and, mounted at the rear end of said structure 110 is a vertical plate 112 on which a small gasoline powered motor may be conveniently mounted. The proximity of both motormount 72 and motormount 112 to the chair 68 makes it very easy for an operator to handle a motor which might be affixed to either of said mounting plates. And, to foster ease in reaching a rear-mounted motor, the seat 68 is preferably mounted with a swivel base, so that a person can easily rotate to the rear for starting the motor and then turn to the front for operating it (with his feet on the deck plate 82).

A distinct advantage of the watercraft described herein is its small size, shallow draft, and light weight. Nevertheless, the watercraft offers most of the good features which are provided by much more expensive bass boats and the like. Too, for a duck hunter wishing to be relatively inconspicuous among a clump of high grass, etc., the low profile of the watercraft offers a distinct advantage—in comparison with much larger boats. In spite of its small size, however, it has exceptional stability, and its center of gravity is low enough to essentially preclude capsizing while still being high enough to prevent most waterspray from reaching an occupant. However, the watercraft's small spatial envelope (approximately 40 square feet) does probably encourage an operator to venture into brushy regions and rough spots around a shore that he would not go into with a large boat. To further improve the resistance of the watercraft to being damaged by submerged stumps and the like in these traditional good fishing spots, the bottom part of a pontoon skin 18 can advantageously be made somewhat thicker than the top; and, thickness of 0.150 inch for the bottom piece 120 and 0.125 inch for the top piece 122 have been found to be quite satisfactory. With a flat bottom on the pontoons 12, 14, the boat has a very shallow draft, typically about 5½ or 6 inches with the boat fully loaded with fishermen, a 5 hp motor, an ice chest, tackle boxes, etc. This leaves at least a few inches of space from the water line up to the joint between edges 124, 126 of the two skin sections. The resilient bumper 130 is therefore exposed above the water line even when the watercraft is heavily loaded, and the craft may be tied alongside most any structure (including a larger boat or cruiser) without risking any damage to the structure's surface. Perhaps it should also be mentioned that the lack of any rigid connection between the floatation bodies and their protective skins 18 is also useful when a submerged stump or a sand bar is accidentally struck. The fact that some relative movement between a skin 18 and a foamed plastic body 16 is possible means that the tough polyethylene skin 18 can yield slightly and act somewhat in the nature of a shock absorber.

Another advantage of the relatively small size of the watercraft when employed as a fishing platform is that a fisherman can sit in the center of the boat and turn 360 degrees while holding a fishing rod horizontally outward—and a fish on the end of the line will never have a chance to cut underneath the boat in order to hang up the line. Nevertheless, if some obstruction or fouled line should prompt a fisherman to seek access to the "bottom" of his boat, both the floorboard 82 and a chair 68 could be removed without interfering with the structural integrity of the boat.

While only a few embodiments of the invention have been disclosed herein in great detail, it should be readily apparent to those skilled in the art that modifications thereof may be accomplished without departing from the spirit and scope of the invention—which is particularly identified in the claims appended hereto.

What is claimed is:

1. Attachment means for a knock-down boat, comprising (a) an elongated structural member having a pair of relatively short slots in one of its sides, and each of said slots being in open communication with the opposite side of the structural member;

(b) a pair of second structural members positioned internally of a floatation member of the boat and each being adapted to be bolted to the first structural member, and there being an internally threaded bore in each second member in a position such that it can be aligned with a respective slot in the first structural member (c) a pair of eye bolts having threads which mate with a respective one of the internally threaded bores, and each eye bolt having a ring which is sized to pass through an associated slot when centered and aligned longitudinally therewith and to hold the first structural member to a second structural member when said eye bolt is aligned transversely and (d) means for holding each of the two eye bolts at the ends of their associated slots on the first structural member, such that the eyebolts are not centered with respect to their associated slots, whereby the eyebolts are effective to hold first and second structural members together for as long as the eyebolts remain threadably engaged with the second structural member and without regard for the orientations of the eyebolts with respect to their associated slots.

2. Attachment means for a knock-down boat, comprising:

(a) an elongated structural member having a pair of relatively short slots in one of its sides, and each of said slots being in open communication with the opposite side of the structural member;

(b) a pair of second structural members positioned internally of a floatation member of the boat and each being adapted to be bolted to the first structural member, and there being an internally threaded bore in each second member in a position such that it can be aligned with a respective slot in the first structural member;

(c) a pair of eye bolts having threads which mate with a respective one of the internally threaded bores, and each eye bolt having a ring which is sized to pass through an associated slot when aligned longitudinally therewith and to hold the first structural member to a second structural member when said eye bolt is aligned transversely, and (d) means for locking an eye bolt in a transverse direction so that it cannot be returned to a longitudinal direction in preparation for passing through its associated slot, and said means constituting a U-shaped clip adapted to slide over the elongated structural member, and the clip having a slot which makes a substantial angle with respect to the slot in said structural member, and the depending legs of the U-shaped clip being self-securing with respect to said structural member.

3. Attachment means for a knock-down boat comprising:

(a) an elongated structural member having a relatively short slot in one of its sides, and said slot being in open communication with its opposite side;

(b) a second member adapted to be bolted to the first member, and there being an internally threaded bore in said second member in a position such that it can be aligned with the slot in the elongated member;

(c) an eye bolt having threads which mate with said internally threaded bore, and having a ring which is sized to pass through the slot when aligned longitudinally therewith and to hold the structural member to the second member when said eye bolt is aligned transversely; and (d) wherein the elongated structural member constitutes a tubular member adapted to rigidly connect a pair of separable boat sections to each other, and said tubular member has a substantially planar surface for bearing against the second member, whereby bending loads on the eye bolt are minimized and pure tension loads in the bolt are fostered when torque loads are applied to said tubular member.

4. Attachment means for a knock-down boat, comprising:

(a) an elongated structural member having a relatively short slot in one of its sides, and said slot being in open communication with its opposite side;

(b) a second member adapted to be bolted to the first member, and there being an internally threaded bore in said second member in a position such that it can be aligned with the slot in the elongated member;

(c) an eye bolt having threads which mate with said internally threaded bore, and having a ring which is sized to pass through the slot when aligned longitudinally therewith and to hold the structural member to the second member when said eye bolt is aligned transversely; and (d) a rigid locking member having a width which is small enough to enter the slot in the elongated structural member, and having a length which is shorter than the unfilled space remaining in said slot when the eye bolt is positioned therein, such that both the shank of the eye bolt and the locking member can fit into the slot simultaneously, and wherein the ring of the eye bolt cannot pass through the slot when the locking member is in said slot.

5. The construction as claimed in claim 4 wherein said locking member has a head which is adapted to bear against the elongated structural member in order to prevent said locking member from passing completely through the slot when it is inserted therein.

6. The construction as claimed in claim 5 wherein the head has a configuration which permits it to be manually gripped at will and pulled away from the elongated structural member.

* * * * *